US005721663A

United States Patent [19]

Smith et al.

[11] Patent Number: 5,721,663

[45] Date of Patent: Feb. 24, 1998

[54] OVERVOLTAGE PROTECTION MODULES WITH BACK-UP PROTECTION FOR COMMUNICATION LINES

[75] Inventors: Thomas J. Smith, Bay Shore; Nisar Chaudhry, West Babylon, both of N.Y.

[73] Assignee: Tii Industries, Inc., Copiague, N.Y.

[21] Appl. No.: 773,274

[22] Filed: Dec. 23, 1996

Related U.S. Application Data

[63] Continuation of Ser. No. 375,377, Jan. 17, 1995, abandoned.

[51] Int. Cl.[6] ..... H01C 7/12

[52] U.S. Cl. ..... 361/119; 361/111

[58] Field of Search ..... 361/56, 91, 111, 361/119

[56] References Cited

U.S. PATENT DOCUMENTS

| | | | |
|---|---|---|---|
| 4,907,120 | 3/1990 | Kaczmarek et al. | 361/119 |
| 5,224,013 | 6/1993 | Pagliuca | 361/119 |

*Primary Examiner*—Fritz Fleming
*Assistant Examiner*—Sally C. Medley
*Attorney, Agent, or Firm*—Martin Sachs

[57] ABSTRACT

A miniature station overvoltage protection module having a surge protector device and a back-up protector suitable for use on communication lines, includes a hollow housing having a top surface; a pair of line terminals and a ground terminal disposed in the housing top surface, extending inside the hollow housing. A holding bracket affixed to the housing ground terminal disposed within the hollow housing includes first and second conductors and a ground conductor, each of the first and second conductors extends towards one of the pair of line terminals and is in electrically conductive contact therewith; the ground conductor is in electrically conductive contact with the ground terminal. A surge arrester, having at least a pair of electrode terminals and a ground terminal connected to the housing ground terminal. Each one of the pair of surge arrester electrode terminals is in electrically conductive contact with one of the pair of line terminals. Additionally included is a pair of two terminal solid state back-up protection devices, one of the protection devices is disposed between each electrode of the surge arrester and the ground conductor, with one terminal of each being in intimate electrically conductive contact with each one of the surge arrester electrode terminals.

9 Claims, 6 Drawing Sheets

OVERVOLTAGE PROTECTION MODULES WITH BACK-UP PROTECTION FOR COMMUNICATION LINES

The present application is a Continuation of parent application Ser. No. 08/375,377 filed Jan. 17, 1995, now abandoned.

FIELD OF THE INVENTION

The present invention relates to miniature station overvoltage protection modules having a surge protector device and a back-up protector suitable for use on communication lines, and in particular, to a miniature station overvoltage protection device, which includes a solid state back-up protection device affixed to the surge protector device.

DISCUSSION OF THE RELEVANT ART

The problem of protecting telecommunication transmission lines from lightning strikes or other sources of overvoltage has been around for a very long time. Numerous devices have been utilized over the years to protect these communication lines from overvoltages. The art abounds with different techniques dating back from the original spark gap protectors and carbon block overvoltage protectors to gas tube protectors and air gap back-up protection devices, so that if the primary surge arrester were to fail, the back-up device takes over, thereby protecting the communication lines from overvoltage transients. Each of these devices has had shortcomings. Numerous attempts have been made to improve the state of the art to provide for a more reliable apparatus.

In some of the designs, a solid state break-over device is utilized together with a gaseous discharge tube-type arrester. Alternately, an air-gap is connected in parallel with a gas tube, so that the gas tube arrester will dissipate the overvoltage energy, and when it fails, the air-gap would protect the communication lines. In another design, semiconductor devices placed in parallel with the gas tube would break down, dissipating most of the energy, since a second bilateral nonlinear semiconductor can carry greater energy-dissipating qualities, thereby protecting the amount of energy that has to be absorbed by the gas tube placed in parallel therewith. Typical of a multi solid state arrangement in parallel with a gas tube is disclosed in U.S. Pat. 4,023,071, issued to G. W. Fussell on May 10, 1977.

Another type of break-over device utilizes oppositely poled, zener diodes connected from each of the terminals of the surge arrester to ground, with a variable impedance placed between the back-up semiconductor surge protector and the main surge protection device, so that the semiconductor device, which operates much faster than the gas tube, and the variable impedance placed between the electrode and ground helps dissipate the energy and protects the gas tube from overheating. This type of protection device is disclosed in U.S. Pat. No. 4,907,120, issued to R. Kaczmarek, on Mar. 6, 1990. Another arrangement is disclosed in U.S. Pat. No. 4,625,255, issued to J. Borkowicz on Nov. 25, 1986.

Later developments in the overvoltage protection art included the use of back-up air gaps disposed in a parallel path with the overvoltage surge protection device, so that if the surge protection device failed to operate or was struck with a tremendous overvoltage, the air gap would break down, protecting the communication line. A typical device is disclosed in U.S. Pat. No. 5,282,109, issued to T. J. Smith on Jan. 25, 1994.

In still another approach to protect the overvoltage from damaging the communication lines, solid state overvoltage protectors were designed to include a thermally sensitive material disposed between the surge arrester electrodes and the ground connection, thereby providing overheating protection by positively shorting the line terminals to ground if the overvoltage protection device should overheat. The technique of using a gas tube together with a back-up air gap provided by a dielectric disposed between the line terminals and the ground connection is disclosed in U.S. Pat. No. 5,224,013, issued to E. G. Pagliuca on Jun. 29, 1993.

There are inherent problems with each of the devices known in the prior art, which has been the subject of much research in order to provide a stable, reliable overvoltage protection device.

Therefore, it is an object of the present invention to provide a miniature station overvoltage protection module with a back-up protector, which is reliable and has a readily controllable breakover voltage.

It is another object of the present invention to provide a miniature station overvoltage protection module for communication systems that has an almost instantaneous response to an overvoltage and also provides for fail-safe protection.

It is still a further object of the present invention to provide a miniature overvoltage protection module, which may utilize a gas-tube surge protector device, as well as solid state protection devices, and utilizes a back-up solid state device having a breakdown voltage sightly below the breakdown voltage of the main surge arrester at a fast rate of rise of impressed voltage.

It is yet a still further object of the present invention to provide a miniature overvoltage station protector which is fast operating, reliable, and capable of providing fail-safe protection, together with heat sensitive overvoltage protection.

SUMMARY OF THE INVENTION

A miniature station overvoltage protection module having a back-up protector suitable for use on communication lines, according to the principles of the present invention, includes a hollow housing having a top surface; a pair of line terminals and a ground terminal disposed in the housing top surface extending inside the hollow housing; the ground terminal being intermediate the pair of line terminals. A holding bracket is affixed to the housing ground terminal and is disposed within the hollow housing; the holding bracket includes first and second conductors and a ground conductor, each one of the first and second conductors extends towards one of the pair of line terminals and is in electrically conductive contact therewith; the ground conductor is in electrically conductive contact with the ground terminal. A surge arrester having at least a pair of electrode terminals and a ground terminal has the ground terminal thereof in electrically conductive contact with the housing ground terminal. Each one of the pair of surge arrester electrode terminals is in electrically conductive contact with one of the pair of line terminals. A pair of solid state protection devices, each of the solid state protection devices has two terminals, one of the protection devices is disposed between each electrode of the surge arrester and the ground conductor with one terminal of each of the solid state protectors being in intimate electrically conductive contact with each one of said surge arrester electrode terminals.

The foregoing and other objects and advantages will appear from the description to follow. In the description, reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims. Like-reference characters are utilized to designate like or corresponding components in the alternative embodiments, in order for the reader to better understand features of the invention.

BRIEF DESCRIPTION OF THE DRAWING

In order that the invention may be more fully understood, it will now be described, by way of example, with reference to accompanying drawing in which.

DESCRIPTION OF THE PREFERRED EMBODIMENTS

Figure 1:
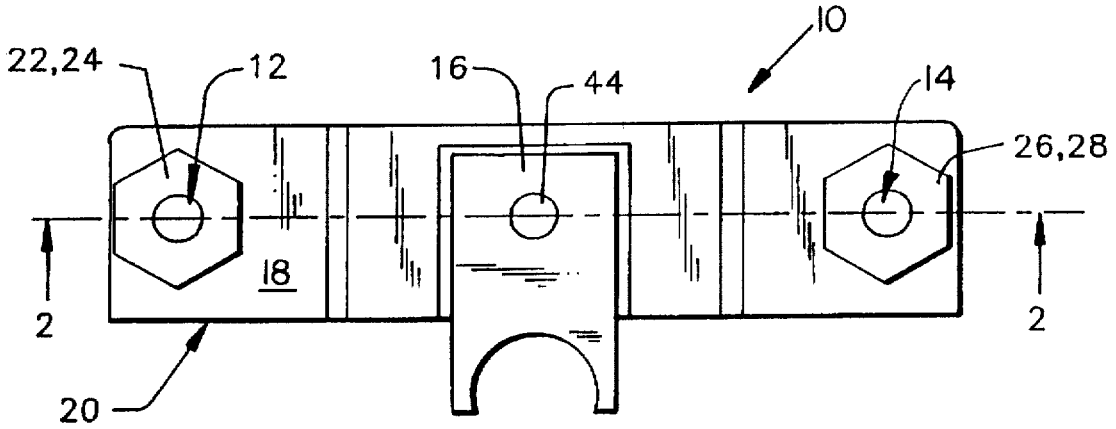
FIG. 1 is a top plan view of a miniature station overvoltage protection module, according to the principles of the present invention.

Referring now to the figures, and in particular to FIG. 1, there is shown a top plan view of a miniature station overvoltage protection module 10 suitable for protecting communication systems, according to the principles of the present invention, which includes a pair of line terminals 12 and 14 with a ground terminal 16 disposed on the top surface 18 of a hollow housing 20. Terminals 12 and 14 are threaded studs and have threaded nuts 22, 24, and 26, 28, threaded thereon in a conventional manner. One distal end 30 of terminal 12 and one distal end 32 of terminal 214 is seen to extend into the inside of the hollow housing 20. Terminals 12 and 14 are held in place by the tightening down of nuts 24 and 28, respectively, so that the knurled portions 36 and 38 are forcibly held within apertures 40 and 42, respectively, provided in the housing top surface 18. Communication lines, not shown, may be fastened between the nuts 22 and 24, and 26 and 28, in a conventional manner (see FIG. 2).

Ground terminal 16 also extends into the inside 34 of housing 20 and is held in position with the aid of a rivet 44, which extends through the housing 20, ground terminal 16, extending bracket 46 or similar device, wherein it is peened over in a conventional manner, thereby making continuous electrical conductive contact between the bracket 46, ground terminal 16, and ground clip 48, if utilized.

Figure 2:
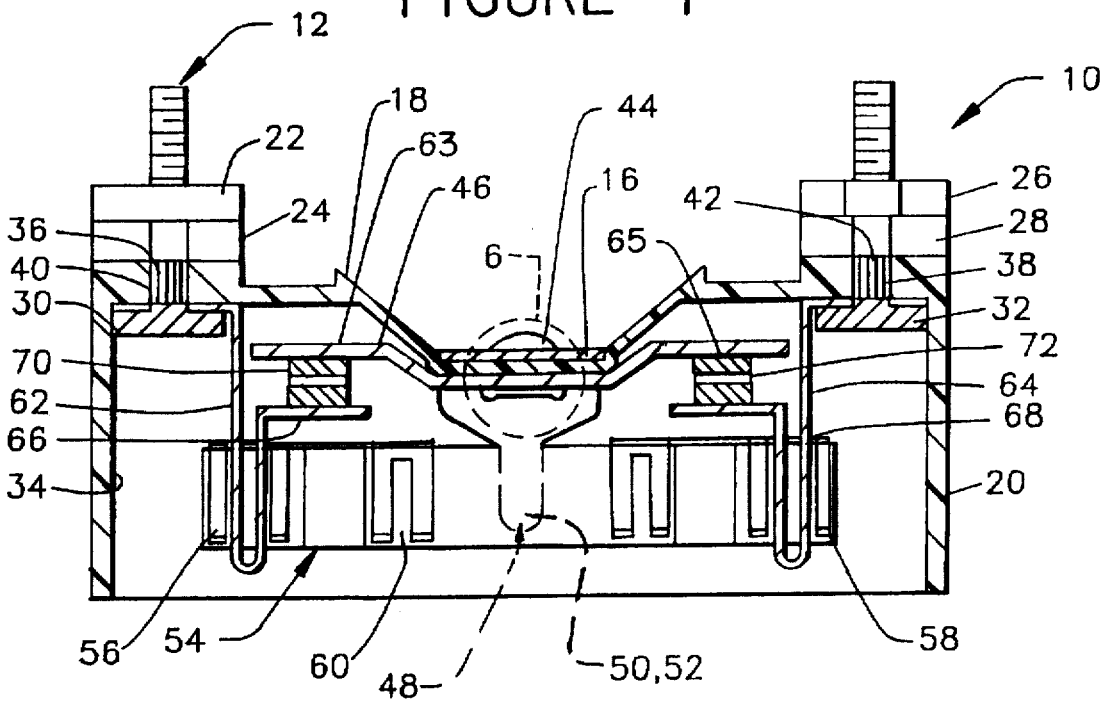
FIG. 2 is a cross-sectional view in elevation of the apparatus disclosed in FIG. 1, essentially taken all along the line 2—2 therein.
Figure 6:
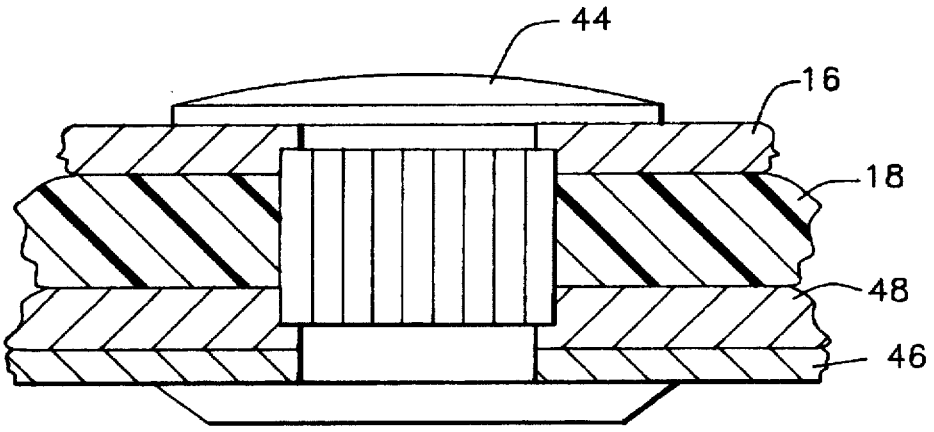
FIG. 6 is a greatly enlarged cross-sectional view of the area shown within the broken lines of FIG. 2.

The arrangement of components of the ground clip, and its associated arrangement of parts, is more clearly shown in the enlarged cross-sectional view shown in the broken lines of FIG. 2 and shown in cross-section in FIG. 6.

Referring now to FIG. 2, the ground clip 48 is provided with a pair of fingers 50, 52 (52 not shown for clarity), which are adapted to receive therebetween a gas tube surge arrester 54. Gas tube surge arrester 54 has electrode terminals 56 and 58 provided on the distal ends thereof and a centrally disposed ground terminal for electrode 60. Ground electrode 60 is in electrical conductive contact with ground clip 48, and thus, is connected to the ground terminal 16, which in turn is connected to the communication system ground. Holding brackets 62 and 64 extend from the distal ends 30 and 32 of terminals 12 and 14, respectively, to the terminal electrodes 56 and 58, respectively, and are adapted to hold the electrode terminals therein. Extending bracket 46 is disposed proximate the distal ends 63 and 65 thereon, and extending portions 66 and 68 of brackets 62 and 64, respectively, maintain therebetween avalanche diodes 70 and 72, respectively, so that one electrode of avalanche diode 70 and 72 make electrical conductive contact to the ground terminal 16, extending bracket 46, and form electrically conductive contact with electrodes 56 and 58, respectively, via the extending portions 66 and 68 of brackets 62 and 64, respectively. The surge arrester 54 may be purchased from TII Industries, Inc., of Copiague, N.Y., as part number TII-31 and avalanche diode may be purchased from TECCOR, Inc., located in Texas, as part number 1.5KE400.

Figure 3:
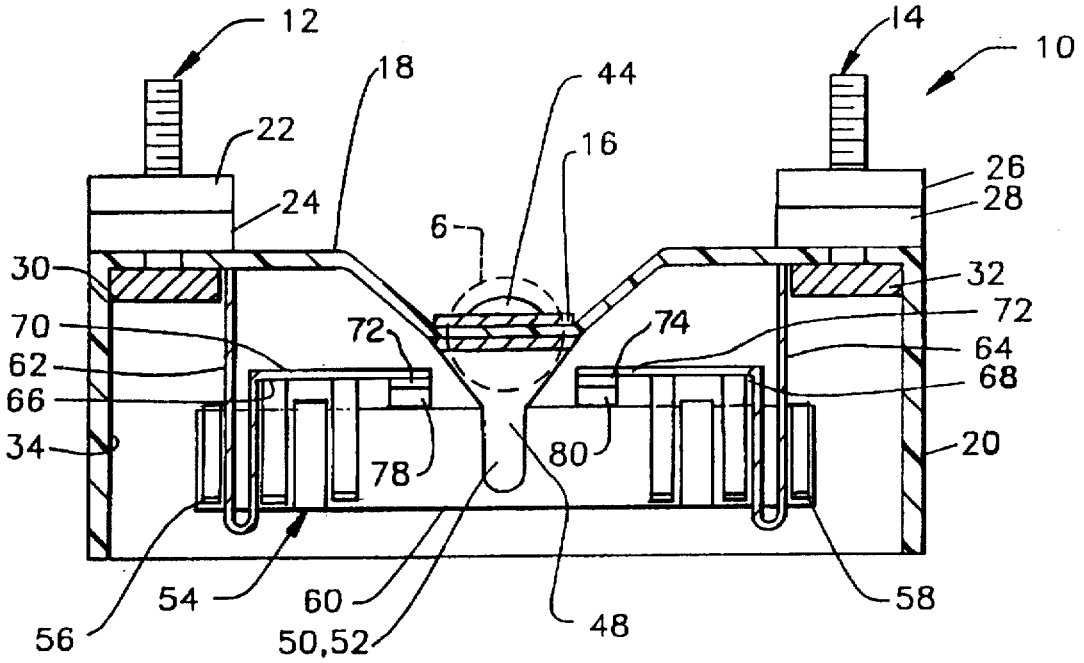
FIG. 3 is a slightly reduced cross-sectional view in elevation, essentially taken along the line 2—2 of FIG. 1, with an alternative embodiment disclosed therein.

Referring now to FIG. 3, which is an alternative embodiment of the apparatus disclosed in FIG. 2, the surge arrester 54 is held in the fingers 50 and 52 of ground clip 48, making electrically conductive contact with the ground electrode 60, and the electrodes 56 and 58 are received by and supported by brackets 62 and 64, respectively, in the same manner as that described with regard to FIG. 2. Extending portions 66 and 68 and the distal ends 70 and 72, respectively, are provided with a contact portion 78 and 80, which will short to ground electrodes 12 and 14, via brackets 62 and 64, respectively.

Figure 4:
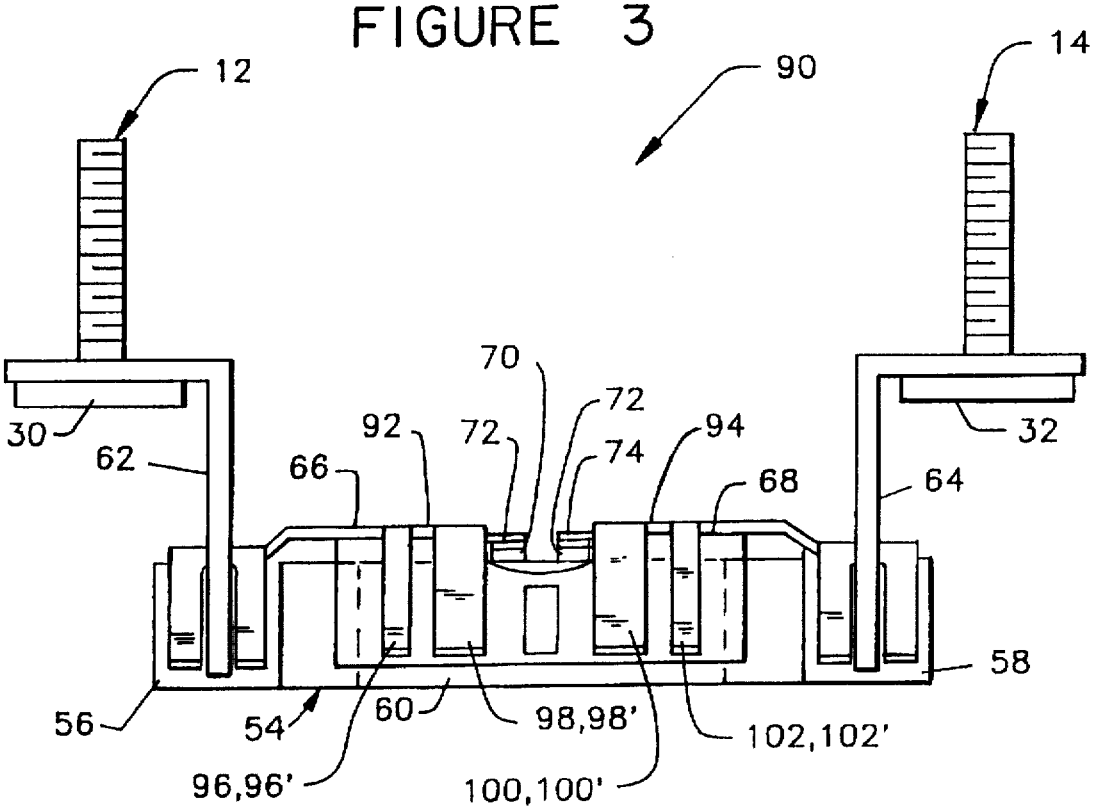
FIG. 4 is an enlarged view of yet another embodiment of the inner portion of the protection module with the solid state back-up device affixed on the surge arrester in a manner different than that shown in the embodiments of FIGS. 2 and 3.

Referring now to FIG. 4, which is another alternative embodiment of the surge protection assembly 90 that is enlarged to better determine the arrangement of the components. The gas tube surge arrester 54 is held between the two terminals 12 and 14 by means of a pair of brackets 62 and 64, in a manner similar to that disclosed for the other embodiments. The ground clip 48 is not shown in this figure so that the location of the avalanche diodes 70 and 72 may be readily seen. Brackets 66 and 68 have one end thereof disposed and adapted to receive electrodes 56 and 58 of the surge arrester 54. At the distal ends of brackets 62 and 64, two separate brackets may be affixed therein, or brackets 62 and 66 may be combined into one bracket.

Additional holding clips 92 and 94 are provided with fingers 96 and 96', 98 and 98', 100, and 102 respectively, and are adapted to receive the surge arrester 54 therein, and in addition, put pressure on the extending portions 66 and 68, respectively, of brackets 62 and 64, respectively, so that avalanche diodes 70 and 72 are held in intimate electrically conducting contact with the ground electrode 60 of the surge arrester 54, and in electrically conductive contact with electrode terminals 56 and 58 along a radial axis of the surge arrester 54. Thus, if the avalanche diode voltage is exceeded because of a transient occurring on either terminal 12 or 14, it causes the avalanche diode 70 and/or 72 to break down and protect any equipment connected to the line terminals 12 and 14 until the surge arrester 54 is able to break down and take the major portion of the surge current that occurs.

Should the heat sensitive material 112 be caused to melt by overheating of the surge arrester 54, it would cause brackets 92 or 94 to come into contact with the ground electrode 60 of the surge arrester 54, shorting to ground either terminal 56 and/or terminal 58, depending upon the source or cause of heat, by the amount of current carried by one of the conducting paths of the surge arrester. This arrangement provides fail-safe protection by having both short circuit protection for overheating and back-up surge protection by using the avalanche diodes 70 and 72 to protect the surge arrester 54.

Figure 5:
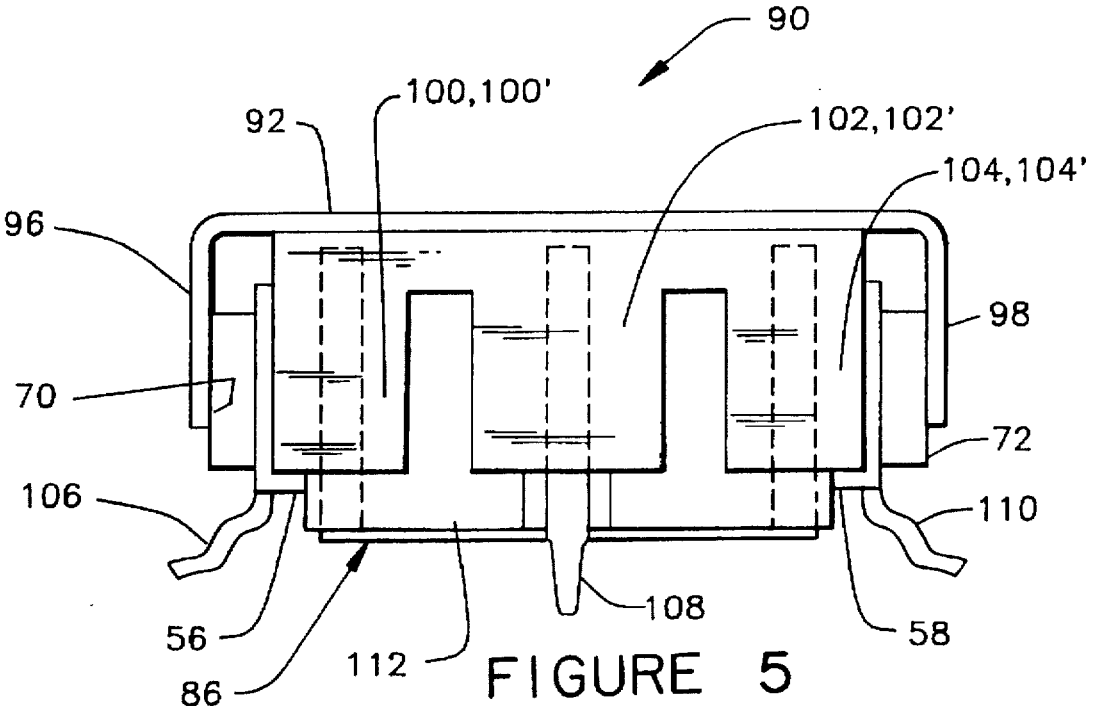
FIG. 5 is a enlarged view of the surge protector apparatus and the back-up solid state protector affixed thereon suitable for insertion into the housing shown in cross-section in FIG. 3.
Figure 5A:
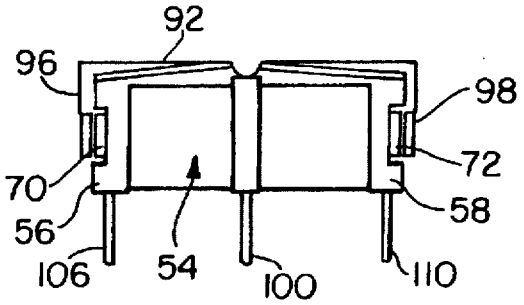
FIG. 5A is a slightly enlarged view of an alternative design of the surge arrester with the back-up solid state protector elements and fail safe clip.

Referring now to FIGS. 5 and 5A, which are still yet additional alternative embodiments of the surge protection assembly 90, that may include a gas tube or a solid state surge arrester, such as that manufactured by TII Industries, Inc., of Copiague, N.Y., and known as Model No. TII-71 or 73. The holding clip 92 is electrically conductive to ground in a manner similar to that disclosed with the description of FIGS. 2 and 3, not shown herein for clarity, and is provided with distal end portions 96 and 98, which are adapted to urge avalanche diodes 70 and 72 against terminal electrodes 56 and 58, respectively, so that one electrode of the avalanche diode 70 or 72 is in intimate conductive contact with the distal end terminals 56 or 58 of the gas tube or solid state surge arrester 86. The fingers 100 and 100'; 102 and 102'; and 103 and 103' are adapted to hold the gas tube or solid state surge arrester 86 therein and are connected to ground to provide an electrically conductive path for one terminal of the avalanche diodes 70 and 72.

Electrically conductive wires 106, 108, and 110, respectively, are connected to the terminal electrodes 106 and 110 and the ground electrode 108. The wires 106, 108, and 110 are connected to the terminals 56, 58, and 60 in a conventional manner, and are connected to the terminal 12, ground terminal 16, and terminal 14 in a conventional manner. In addition, a thermally sensitive plastic insulating material 112 is placed between the surge arrester 86 and the fingers 100, 100' and 104, 104' to prevent the electrodes 56 and 58 from making electrically conductive contact with the ground, via fingers 102, 102' of clip 92, unless overheating occurs and the heat sensitive material 112 melts, allowing contact between the electrodes 56 and 58 of the surge arrester 86 to be shorted to ground.

Figure 7A:
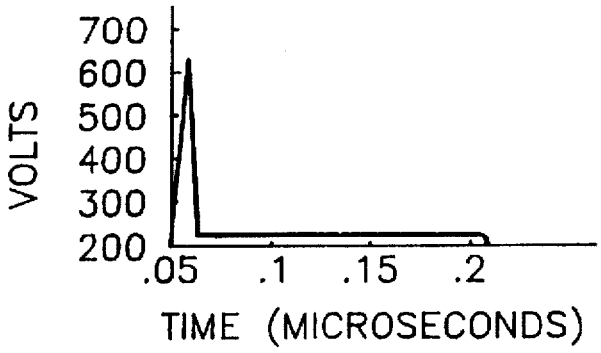
FIG. 7A is a graph of surge voltage versus time for a typical gas tube surge arrester.
Figure 7B:
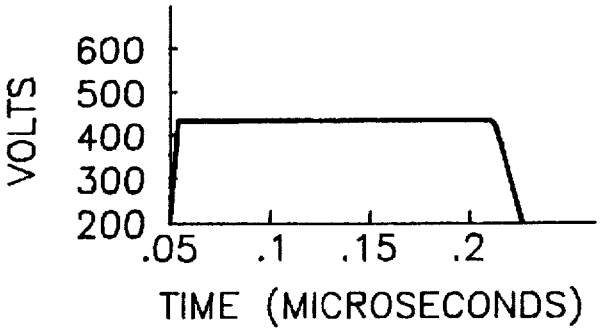
FIG. 7B is a graph of surge voltage versus time for an avalanche diode.
Figure 7C:
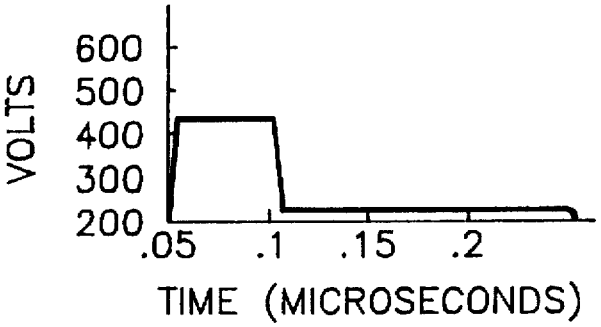
FIG. 7C is a graph of voltage versus time for a gas tube and avalanche diode combination disposed in parallel.

Referring now to FIGS. 7A, 7B, and 7C, which are graphs of surge voltage versus time in microseconds of a surge arrester gas tube alone (FIG. 7A); an avalanche diode alone (FIG. 7B); and a combination of a gas tube and an avalanche diode in parallel therewith (FIG. 7C). The improvement in the overvoltage protection becomes evident when the combination is made, as long as the avalanche diode has a breakdown which is chosen to be slightly lower than the breakdown voltage of the gas tube. One may readily refer to FIG. 7A and determine that the initial rapid rise in the gas tube until it breaks down exceeds 600 volts. In the same period of time, the avalanche diode limits the breakdown to slightly over 400 volts, but cannot dissipate the power without the help of the gas tube, which takes over in roughly 0.05 microseconds, and thus, takes the major portion of any surge voltage, carrying the additional current caused thereby.

Figure 8:
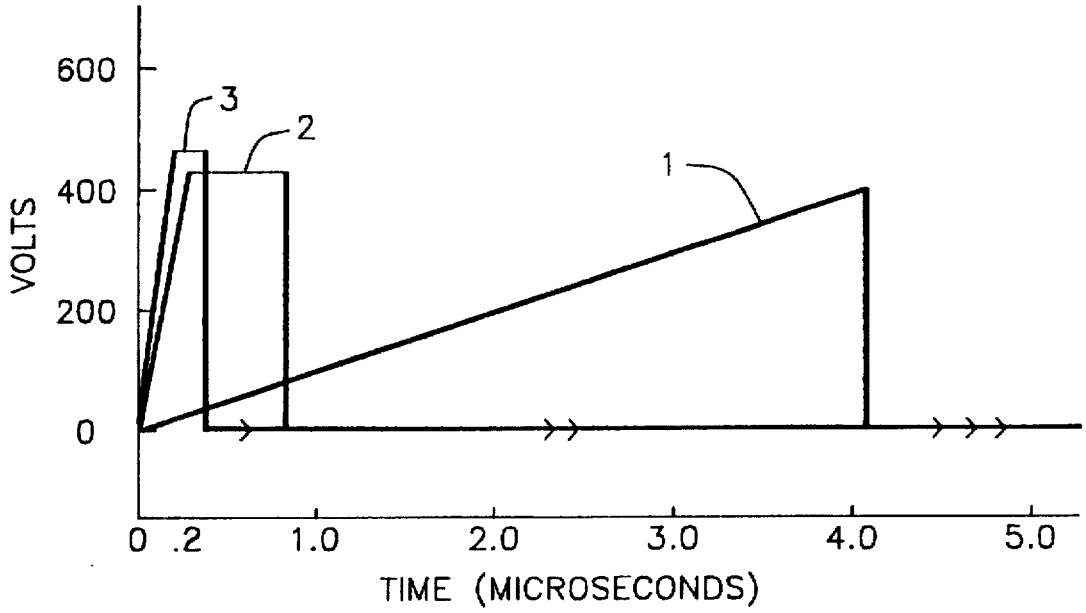
FIG. 8 is a graph of voltage versus time for the breakdown voltage of a gas tube and an avalanche diode breakdown device, with a breakdown voltage applied at a rate of 100 volts per microsecond (curve 1); 3,000 volts per microsecond (curve 2); and 10,000 volts per microsecond (curve 3)

Referring now to FIG. 8, one can see the graph of voltage versus time for the gas tube together with the avalanche diode in parallel therewith when it is surged with a voltage having a rise time of 100 volts per microsecond (curve 1); 3,000 volts per microsecond (curve 2); and 10,000 volts per microsecond (curve 3). The improvement by utilizing the hybrid arrangement of tube and avalanche diode is readily apparent.

Figure 9:
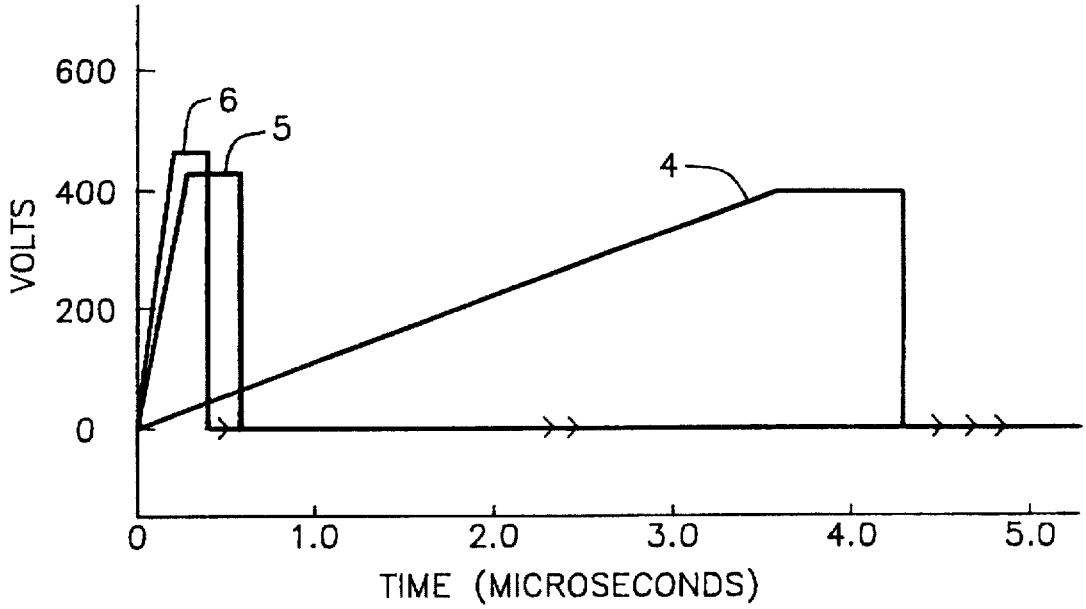
FIG. 9 is a graph of voltage versus time for another type of gas tube with an avalanche diode in parallel therewith, at a rate of 100 volts per microsecond (curve 4); 3,000 volts per microsecond (curve 5); and 10,000 volts per microsecond (curve 6)

Referring now to FIG. 9, which is a graph of volts versus time for a T-11 hybrid arrangement (T-11 tube and avalanche diode), when it is surged with a breakdown voltage of 100 volts per microsecond (curve 4); 3,000 volts per microsecond (curve 5); and 10,000 volts per microsecond (curve 6).

Figure 10:
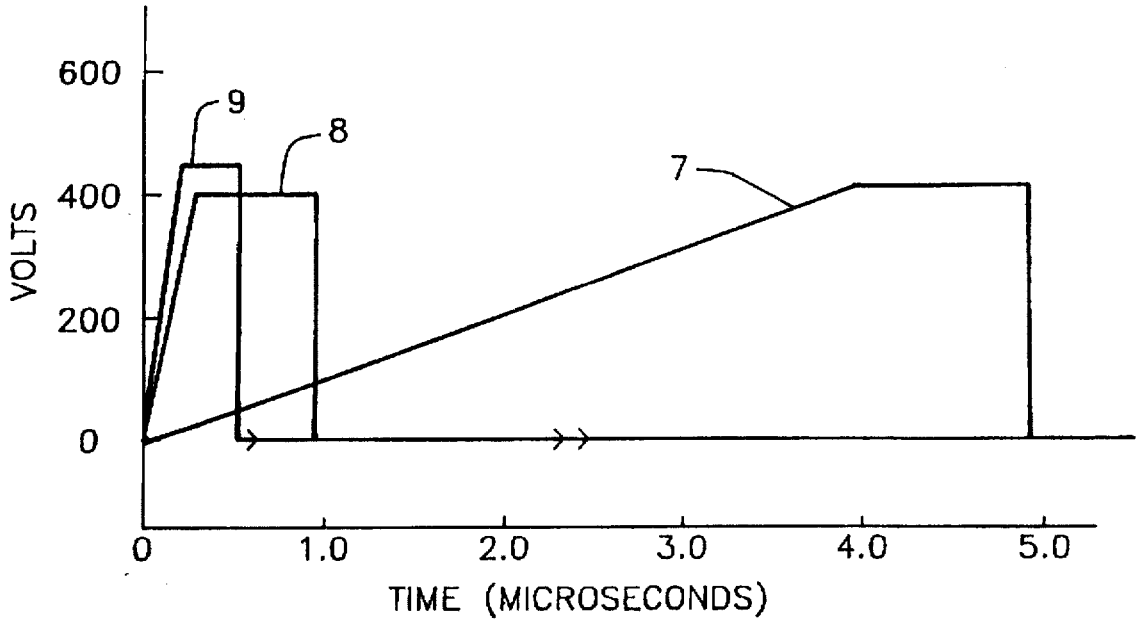
FIG. 10 is a curve of breakdown voltage versus time for yet another type of gas tube with an avalanche diode in parallel therewith at a rate of 100 volts per microsecond (curve 7); 3,000 volts per microsecond (curve 8); and 10,000 volts per microsecond (curve 9)

Referring now to FIG. 10, there is shown the curves of the TII—73 tube and the avalanche diode combination (parallel arrangement), when subjected to a fast rise voltage at 100 volts per microsecond (curve 7); 3,000 volts per microsecond (curve 8); and 10,000 volts per microsecond (curve 9). These graphs clearly show that the avalanche diode provides results far superior than a gas tube alone, when the gas tube has an avalanche diode placed in parallel therewith, with no impedance placed in series with the gas tube and/or the avalanche diode to insure that the power carried because of the overvoltage is dissipated only in the avalanche diode and the gas tube working together.

Figure 11:
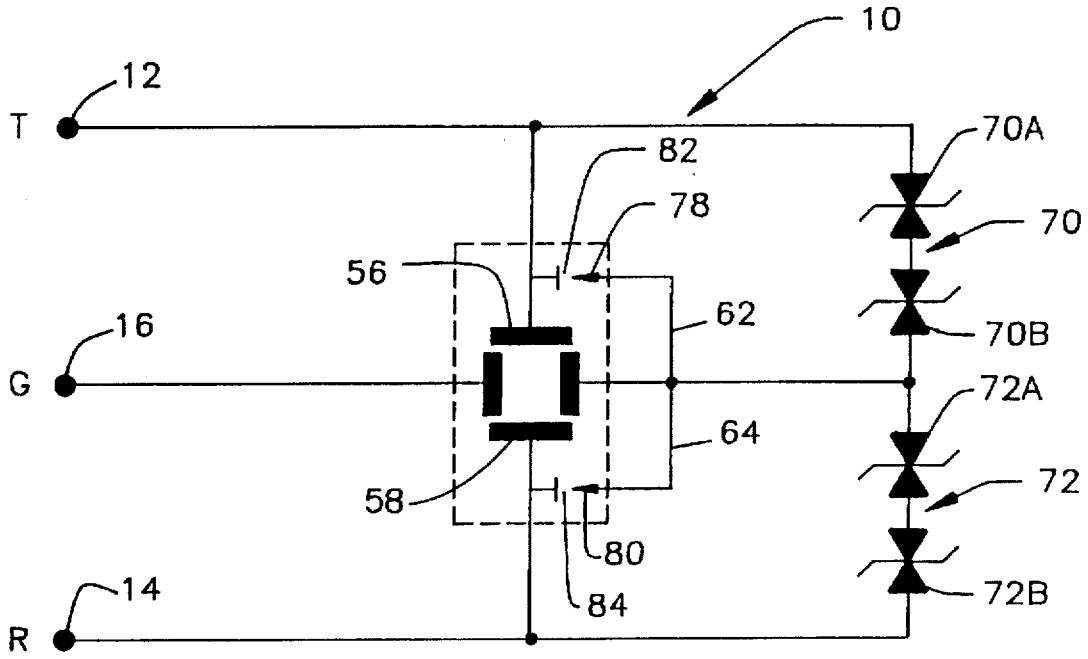
FIG. 11 is a schematic circuit diagram and pictorial representation of the avalanche diodes connected across a gas tube arrangement similar to the arrangement as that set forth in FIG. 3.

FIG. 11 is a schematic and pictorial representation of the mechanical embodiment disclosed in FIG. 3. The line terminals are shown as numerals 12 and 14, which are normally connected to the tip and ring communication lines, with terminal 16 being connected to the system ground. The avalanche diode 70 may consist of more than one diode, such as shown as 70A and 70B, or 72A and 72B, in order to reduce the amount of capacity across the line. The contact portions 78 and 80 of brackets 62 and 64, respectively, will cause the ground to come into contact with electrodes 12 and 14, respectively, if the thermally sensitive material placed between the contact portions 78 and 80 of brackets 62 and 64 were to melt because of over heating caused by the surge arrester carrying excessive currents.

In operation, use of an avalanche diode connected in parallel with a gas tube surge arrester or a semi-conductor (solid state surge arrester) can prevent surges from appearing on communication lines with a minimum of time delay. The response of the avalanche diode being sufficiently fast, it will conduct (breakdown) almost instantaneously after the overvoltage is applied to the lines, thereby preventing any equipment connected thereto from being damaged until the gas tube surge arrester, or solid state surge arrester is able to conduct the remaining part of the energy.

Hereinbefore has been disclosed a simple, efficient means for overcoming the difficulty of communication lines having transients, such as lightening strikes, causing damage to the equipment connected to these communication lines. It will be understood that various changes in the details, material, arrangement of parts, and operating conditions, which have been herein described and illustrated in order to explain the nature of the invention, may be made by those skilled in the art within the principle and scope of the instant invention.

Having thus set forth the nature of the invention, what is claimed is:

1. A miniature station overvoltage protection module for communication systems comprising:

A. hollow housing means having a top surface and a bottom;

B. a pair of line terminals and a ground terminal disposed in said housing means top surface extending inside said hollow housing means, said ground terminal being intermediate said pair of line terminals;

C. surge arrester means having at least a pair of electrode terminals and a ground terminal, said surge arrester means ground terminal being in electrically conductive contact with said housing means ground terminal, each one of said pair of surge arrester means electrode terminals being in electrically conductive contact with one of said pair of line terminals;

D. bracket means adapted to receive said surge arrester means therein, said bracket means being provided with an electrically conductive path to said ground terminal; and E. a pair of avalanche diodes, each one of said avalanche diodes having two terminals, one of said avalanche diodes being disposed between each one of said pair of electrodes of said surge arrester means and urged thereagainst by said bracket means, one terminal of each of said pair of avalanche diodes being in intimate electrically conductive contact with each one of said surge arrester means electrode terminals.

2. A miniature station overvoltage protection module for communication systems according to claim 1, wherein said surge arrester means is a solid state three terminal device having two independent breakdown paths.

3. A miniature station overvoltage protection module for communication systems according to claim 1, wherein each one of said pair of avalanche diodes is disposed generally in alignment with a radial axis of said surge arrester means.

4. A miniature station overvoltage protection module for communication systems according to claim 1, wherein each one of said pair of avalanche diodes is selected to have a breakdown voltage lower than the breakdown voltage of said surge arrester means.

5. The protection module according to claim 1, wherein said first and said second avalanche diodes are disposed about the radius of said surge arrester.

6. The protection module according to claim 1, wherein said first avalanche diode is located at one end of said surge arrester and said second avalanche diode is located at the other end of said surge arrester.

7. The protection module according to claim 1, further including a cover to seal the bottom of said housing.

8. A fast operating miniature station overvoltage protection module for communication systems having an avalanche diode back-up protector for the communication lines consisting of:

a) a hollow housing having a top surface and a bottom;

b) first and second line terminals and a ground terminal disposed in the top surface of said housing and extending inside said housing, said ground terminal being intermediate said first and said second line terminals;

c) a three terminal gas discharge tube surge arrester having two ends and two independent breakdown paths, said first terminal of said surge arrester being electrically connected to said first line terminal, said second terminal of said surge arrester being directly connected to said second line terminal and said third terminal of said surge arrester being directly connected to said ground terminal;

d) first and second avalanche diode back-up protectors, each avalanche diode having two ends, said first avalanche diode being directly connected between said first terminal of said surge arrester and said ground terminal and said second avalanche diode being directly connected between said second terminal of said surge arrester and said ground terminal, each avalanche diode having a breakdown voltage which is lower than that of said surge arrester; and e) a mechanical structure located within said housing for receiving and retaining said surge arrester and said avalanche diodes, said mechanical structure including at least three conductive members having;

(i) a first conductive member directly connected to said first line terminal, said first terminal of said surge arrester and one end of said first avalanche diode, (ii) a second conductive member directly connected to said second line terminal, said second terminal of said surge arrestor and one end of said second avalanche diode, and (iii) a third conductive member directly connected to said ground terminal and to the other end of each of said first and said second avalanche diodes.

9. The protection module according to claim 8 further including a heat sensitive material disposed between said first conductive member and said third terminal of said surge arrester and between said second conductive member and said third terminal of said surge arrestor.

* * * * *